United States Patent [19]

Widdowson

[11] 3,962,884

[45] June 15, 1976

[54] PILOTED FREEZE THROTTLING VALVE

[75] Inventor: Richard E. Widdowson, Dayton, Ohio

[73] Assignee: General Motors Corporation, Detroit, Mich.

[22] Filed: Nov. 25, 1974

[21] Appl. No.: 526,741

[52] U.S. Cl. ..... 62/217; 62/224; 137/489.3

[51] Int. Cl.[2] ..... F25B 41/04

[58] Field of Search ..... 62/217, 224; 137/489.3; 251/38; 236/54, 80 G

[56] References Cited

UNITED STATES PATENTS

| | | | |
|---|---|---|---|
| 3,452,929 | 7/1969 | Douglas | 236/80 G |
| 3,614,966 | 10/1971 | Orth | 137/489.3 |
| 3,791,578 | 2/1974 | Brand et al. | 236/54 |
| 3,798,921 | 3/1974 | Scherer et al. | 62/517 |
| 3,808,830 | 5/1974 | Atkinson et al. | 62/217 |

*Primary Examiner*—William F. O'Dea
*Assistant Examiner*—Ronald C. Capossela
*Attorney, Agent, or Firm*—K. H. MacLean, Jr.

[57] ABSTRACT

A piloted refrigerant valve for an air conditioning system to control refrigerant pressure within an evaporator to prevent frost accumulation on its exterior surfaces. The valve includes a disc-shaped hollow thermal sensor filled with water which solidifies and expands upon sensing the freezing temperature to cause a pilot valve to block a bleed port and thereby increase the fluid pressure above a reciprocally mounted piston valve. The pressure force produced on the piston valve moves it to a closed position to block refrigerant flow and resultantly to increase refrigerant pressure and temperature in the evaporator. After an initial start-up period of operation, the sensor maintains a position which locates the reciprocal piston valve so as to produce a substantially constant non-freezing temperature of refrigerant in the evaporator.

2 Claims, 1 Drawing Figure

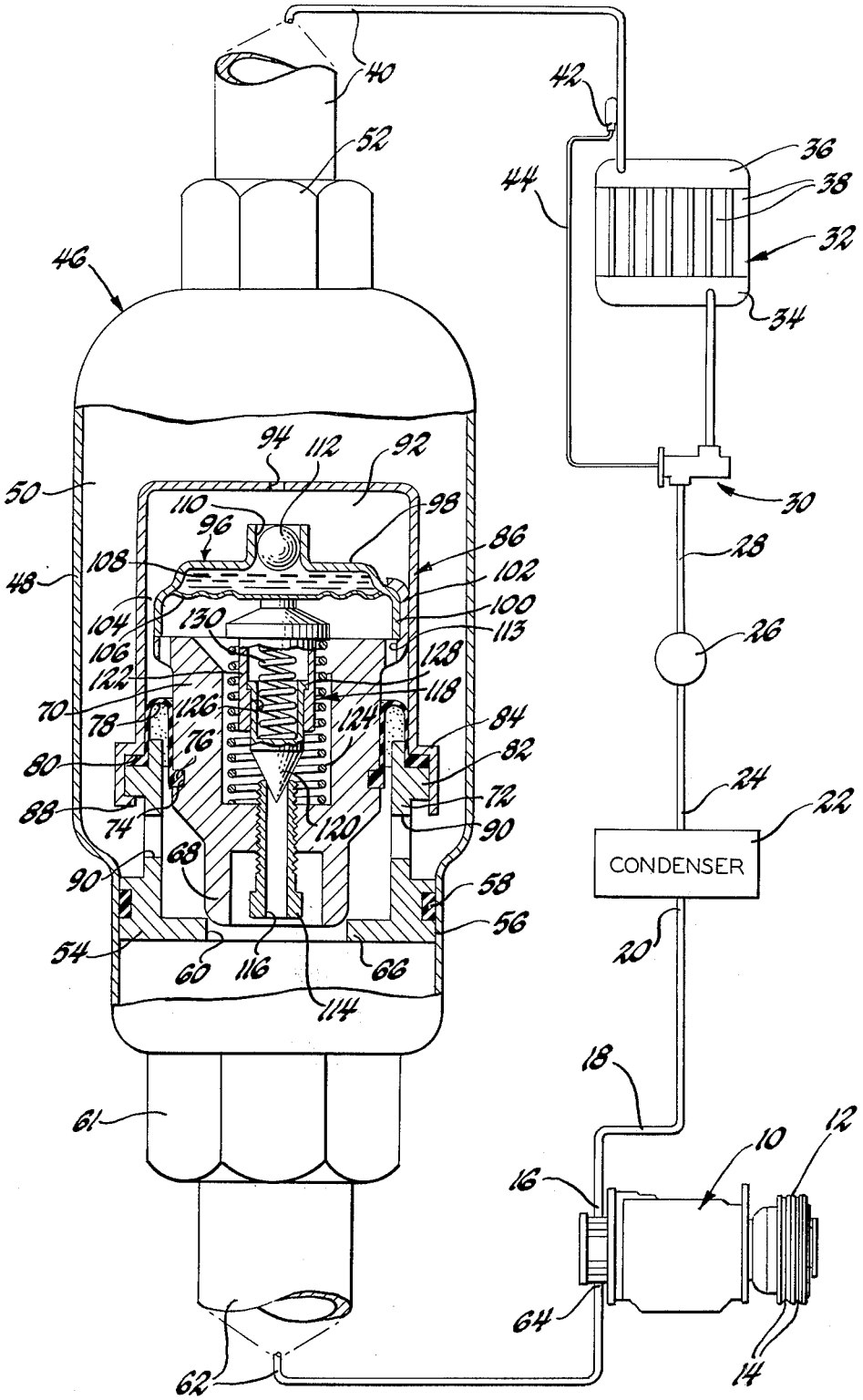
CONDENSER

PILOTED FREEZE THROTTLING VALVE

This invention relates to piloted type refrigerant control valves for use in air conditioning systems.

In present automobile air conditioning systems, a refrigerant compressor is driven by the variable speed internal combustion engine. Since the pumping or compressing capacity of the compressor is proportional to changes in the engine speed, the engine speed directly affects the cooling performance of the system. Also the cooling capacity of the evaporator at any given ambient temperature is limited by heat transfer considerations relating to the design of the evaporator and therefore at times the compressor capacity may greatly exceed the evaporator capacity.

Unfortunately, changes in compressor capacity are not conveniently or economically regulated to make them correspond to the cooling capacity of the evaporator. Thus, in operation under low ambient temperature conditions, the compressor capacity usually exceeds the ability of the evaporator to extract heat from air passing over its exterior finned surfaces. Under these conditions, refrigerant pressure within the evaporator will decrease due to an excess liquid refrigerant supply or, conversely, to incomplete vaporization of refrigerant therein. Also, the increased rate of discharge from the evaporator back to the compressor during high speed operation of the compressor will decrease evaporator pressure and temperature. Refrigerant pressure may eventually decrease below a pressure level corresponding to a freezing temperature on the exterior fin surfaces of the evaporator. When the finned surfaces drop below a temperature of 32°F., frost will usually begin to accumulate thereon. The frost accumulation is undesirable because it decreases the rate of heat transfer between air and the evaporator structure and eventually may entirely block air flow through the evaporator.

It is desirable to provide means to prevent the refrigerant temperature within the evaporator from falling below a level corresponding to freezing temperatures on the exterior finned surfaces. The present air conditioning system includes a piloted temperature sensitive throttling valve which is located between the evaporator and the compressor inlet. Under the aforedescribed conditions of low ambient temperatures and excess compressor capacity, the control value moves toward a closed position to restrict refrigerant flow from the evaporator to the compressor. The restriction or throttling of refrigerant has the effect of maintaining sufficient refrigerant in the evaporator to increase the refrigerant pressure in the evaporator and thereby increase the refrigerant temperature.

The present invention utilizes a thermal sensor to position a pilot valve with respect to an air bleed passage to control the refrigerant pressure within an enclosure partially formed by a reciprocal refrigerant control valve. The pressure of refrigerant in the enclosure moves the control valve to a position regulating refrigerant flow from the evaporator to the compressor inlet and thereby regulates in evaporator pressure. The temperature sensor is a relatively flat disc-shaped member with a flexible wall and a sealed interior filled with a thermally expansive fluid, such as water. When the fluid within the thermal sensor begins to solidify and thereby expand, the operably connected pilot valve moves with respect to the open end of a bleed passage to control pressure within the enclosure thereby regulating the position of the main control value.

The aforedescribed piloted control valve is an improvement over the control valve utilizing a water-filled sensor disclosed in U.S. Pat. No. 3,798,921 issued Mar. 26, 1974 and assigned to the General Motors Corporation. In that refrigerant controller, an expansive water-filled temperature sensor is directly connected to the main flow control valve to provide operating characteristics in accord with temperature changes. It requires a relatively large thermal sensing actuator with a considerable quantity of fluid therein. Also, the actuator must be capable of relatively large contraction and expansion to move the refrigerant valve sufficiently to control refrigerant flow over a relatively wide range of flow rates. In contrast, the subject piloted freeze actuated throttling valve utilizes a relatively compact fluid-filled thermal sensor and actuator requiring very little fluid therein. This permits the sensor to react quickly to changes in temperature. The relatively small and compact sensor has a relatively limited actuating movement associated therewith but the limited movement is sufficient to accurately position the pilot valve with respect to a bleed port which thereby controls pressure in a control chamber for a main refrigerant valve.

Therefore, an object of the present invention is to provide a simple and compact refrigerant control valve to maintain evaporator pressures at levels sufficient to prevent frost accumulation and including a water-filled thermal sensor of relatively small volumetric capacity which controls a pilot valve.

A further object of the present invention is to provide a compact and efficient refrigerant control valve having a water-filled thermal sensor and actuator which positions a pilot valve with respect to a bleed port to establish a control pressure for positioning a main flow control valve.

Further objects and advantages of the present invention will be more readily apparent from the following detailed description, reference being had to the accompanying drawing in which a preferred embodiment is illustrated.

In the drawing, an automobile air conditioning system is illustrated including an elevational view of the subject refrigerant control valve partially sectioned to reveal its interior.

The illustrated air conditioning system includes a conventional refrigerant compressor 10. The drive shaft of the compressor 10 is connected to a pulley assembly 12 which is driven by an automobile engine by belts (not shown) extending through grooves 14 of the pulley. The outlet 16 of compressor 10 is attached by a conduit 18 to the inlet 20 of condensor 22. The condensor 22 is normally located near the front of the automobile to be exposed to a flow of air into the grille for cooling and liquifying warm refrigerant received from the compressor 10. The outlet 24 of the condensor 22 is connected to a receiver-dryer 26 which separates vaporous from liquified refrigerant. In addition, a desiccant within the receiver-dryer 26 removes moisture from the refrigerant. The liquid refrigerant component is then passed on through a conduit 28 to the inlet of a thermal expansion valve 30.

The thermal expansion valve 30 opens and closes to control the flow of refrigerant into an evaporator 32 which is made up as a lower header tank 34, an upper header tank 36 and a plurality of passage-forming tubes 38 therebetween. Liquid refrigerant enters the lower tank 34 and is vaporized by the absorption of heat from air passing over tubes 38. The vaporous refrigerant collects in the upper tank 36 before being withdrawn through a conduit 40. A thermal bulb 42 charged with refrigerant is held in heat transfer relation with the discharge conduit 40 and is connected by a small diameter capillary tube 44 to the main body of the thermal expansion valve 30. The bulb 42 and capillary 44 produce a pressure response to temperature changes to cause the thermal expansion valve to open and close.

Refrigerant discharged from the evaporator 32 passes through the conduit 40 to a piloted suction throttling valve 46. The suction throttling valve 46 includes a housing 48 which defines an interior space 50 which is connected to the conduit 40 by an inlet fitting 52. A valve seat forming member 54 is supported within the interior 50 and includes a side surface 56 grippingly engaged by housing 48. An O-ring seal 58 between the member 54 and the housing 48 prevents fluid leakage therebetween. The member 54 separates the interior 50 into an upstream portion and a downstream portion fluidly connected by a flow aperture 60. The lower downstream portion of the valve housing 48 is connected by an inlet fitting 61 in conduit 62 to the inlet 64 of the compressor 10 to complete a refrigerant circuit.

Refrigerant flow through the piloted suction throttling valve 46 is regulated to prevent the refrigerant pressure in the evaporator from falling below a level corresponding to a temperature therein which would cause the external surfaces of the evaporator to become frosted from moisture condensed from the air flowing thereby. To this end, the valve seat member 54 defines a valve seat 66 about the flow aperture 60. The valve seat 66 is adapted to coact with the end 68 of a piston-type valve member 70 which is reciprocal within a cylindrical portion 72 of the valve seat member 54. The reciprocal valve member 70 has a groove 74 in its periphery which receives the inner edge 76 of a generally annularly shaped diaphragm member 78. The outer edge portion 80 of the diaphragm 78 is held against a flange portion 82 of the member 54 by a portion 84 of an enclosure member 86. The enclosure member 86 is an inverted cup-shaped member with an enlarged diameter end portion adapted to engage the flange portion 82 of member 54. At frequent intervals about the periphery of the member 86, inwardly directed portions or tabs 88 folded over the flange portion 82 of member 54 to secure member 86 to member 54. During an open or partially open mode of operation of the control valve 46, refrigerant flows from the upper portion of space 50 through a port 90 in the member 54. The fluid then flows past the end 68 of the valve member 70 and through the aperture 60 into the lower portion of space 50 which is fluidly connected by inlet fitting 61 and conduit 62 to the inlet 64 of compressor 10.

Enclosure member 86 defines a first enclosure or a control chamber 92 along with diaphragm 78 and the upper portion of the valve member 70. The control chamber 92 is connected to the upper portion of the throttling valve interior 50 by a small restricted opening 94. Opening 94 permits a small quantity of refrigerant to flow into the control chamber 92 and wash the upper surface of second enclosure or a thermal sensor and actuator 96. The sensor 96 includes a relatively rigid-walled housing 98 whose peripheral edge portion 100 is turned downward from the plane of the housing 98 to engage the top surface of piston valve member 70 to support the sensor and actuator 96 and to cause it to move with valve 70 within space 92. At frequent intervals, circumferentially spaced about the periphery of the sensor-actuator 96, upwardly directed finger portions 102 of valve 70 are provided to secure the members 96, 70 together and to define flow passages 104 between the enclosure 86 and the sensor-actuator 96. A relatively thin and flexible diaphragm member 106 is attached at its outer edge to the housing 98 to define a space 108 therebetween. The space 108 is pre-filled with water before final assembly through an opening 110 which is later closed by forcing a ball 112 into friction fit engagement therein.

To provide a flow of refrigerant from opening 94 through space 92 and past the diaphragm 106 of the sensor-activator 96, ports 113 are formed in valve 70 and an adjustable member 114 with a restrictive bleed passage 116 is provided. The member 114 is threadably secured to valve 70 and bleed passage 116 extends axially therethrough. When the valve 70 is in an open or somewhat restricted position, the pressure at the outlet of the valve 46 is lower than the pressure at the inlet and this will cause a flow of refrigerant through opening 94, passages 104 and through the bleed passage 116 to either heat or cool the water in space 106 of the sensor-actuator 96. This flow around the sensor-actuator 96 is controlled by a movable bleed valve assembly 118 which has a conically shaped valve portion 120 engaging the end of member 114 to regulate refrigerant flow through the bleed passage 116. The bleed valve assembly 118 includes member 122 which is attached at its upper end to the mid-portion of the diaphragm 106 to move therewith when the fluid in space 108 expands and contracts. A spring 124 between member 122 and the valve 70 normally biases the upper end of the bleed valve assembly 118 against the diaphragm 106. The conical valving member 120 is mounted within a bore 126 of member 122 and downward movement is limited by engagement between an outwardly directed flange 128 and a shoulder on member 122. A spring 130 within the assembly 118 normally holds the member 120 in its illustrated downward position. However, when diaphragm 106 moves the valve assembly 118 downward past the point where member 120 engages member 114, the spring 130 is compressed to permit upward movement of member 120 within the member 122.

Operation of the air conditioning system in a high ambient temperature produces a relatively warm refrigerant discharge from evaporator 32 into the space 50 of the control valve 46. The flow of warm refrigerant over the sensor-actuator 96 maintains the water in a liquid state. In this position, the bleed valve assembly 118 with the conical valve portion 120 is positioned away from the end of member 114 to permit refrigerant flow through passage 116 from control chamber 92. The reduced pressure within the control chamber 92 causes the valve member 70 and attached sensor-actuator 96 to assume a position away from valve seat 66 so that a good flow of refrigerant passes through the aperture 60.

During operation of the air conditioning system on a mild day when temperatures may range between 60 and 70 degrees, the heat transferred from air to refrigerant in the evaporator may be insufficient to vaporize enough refrigerant and thereby to maintain the pressure above a frost-preventing level. This condition will be affected by the speed at which the engine operates which determines the pumping and thereby the cooling capacity of the compressor. The refrigerant withdrawn from the evaporator by the compressor first passes through the control valve 46. A portion is also drawn through opening 94 and over the sensor-actuator 96 and is discharged through the bleed passage 116. When the refrigerant temperature falls below 32°F., the water in space 108 freezes and expands to move diaphragm 106 downward. This movement causes the bleed valve assembly 118, and specifically valve portion 120 to engage member 114 and to restrict flow through the bleed passage 116. The restriction of refrigerant increases the pressure within control chamber 92 and produces a force on the control valve 70 to move it downward toward the valve seat 66 to restrict or throttle flow between the evaporator and the compressor. Resultantly, the restriction increases the refrigerant pressure within the evaporator and increases its temperature. It also has the effect of reducing the amount of refrigerant returned to the compressor 10 to decrease its cooling capacity.

The aforedescribed increase in evaporator temperature caused by the restriction of flow through the control valve 46 causes ice in the sensor 96 to melt and move the diaphragm 106 and valve assembly 118 upward. This once aagain permits refrigerant to pass through the bleed passage 116, to decrease the pressure in control chamber 92 and effect movement of the piston valve upward to increase refrigerant flow through the valve 46. After a brief period of operation under mild ambient temperature conditions, the bleed valve assembly 118 is positioned with respect to the member 114 to produce a fairly constant flow of refrigerant through the bleed passage 116 and a constant pressure in the control chamber so that the piston valve 70 passes a desirable flow through the throttling valve to continuously maintain the temperature of refrigerant in the evaporator above its freezing level.

Although a preferred embodiment has been described in detail and illustrated in the drawings, other embodiments may be adapted.

What is claimed is as follows:

1. A refrigerant control valve for an air conditioning system including an evaporator and a compressor comprising: an elongated housing defining an interior space and having an inlet and an outlet at either end adapted to be connected respectively to the evaporator and the compressor for fluid flow through the elongated housing; a partition member extending across said interior space between said inlet and outlet and having an aperture therethrough encircled by a valve seat portion of said member; said partition member having an annular wall portion encircling said valve seat portion inward from the peripheral edge of said partition member and extending axially toward the inlet end of the housing; a piston valve reciprocally supported within said annular wall portion of said partition member in coaxial alignment with said inlet, outlet and aperture and having a reduced diameter end portion movable with respect to said valve seat portion of said partition member to control refrigerant flow through said aperture; enclosure-forming means including said partition member and said piston valve defining a pressure control chamber whereby a pressure force on said piston valve is produced to position the valve with respect to said valve seat; said enclosure-forming means having a restricted opening between said control chamber and an upstream portion of said interior space for admitting refrigerant to the control chamber and a bleed passage between said control chamber and a downstream portion of said interior space for discharging refrigerant from said control chamber; a bleed valve operable associated with said bleed passage for controlling refrigerant discharge from said control chamber to requlate the pressure in said control chamber; a temperature responsive sensor-actuator including a housing having a rigid walled portion and a resiliently walled portion with said walled portions closely spaced to define an interior of relatively small volume filled with water whereby ice formation in said interior causes outward movement of said resilient wall with respect to said rigid wall; said sensor-actuator being supported at a peripheral edge of its rigid wall and with said resilient wall adjacent said bleed valve so that movement of said resilient wall caused by ice formation in said sensor interior produces a closing force on said bleed valve whereby the resultant restriction of fluid flow through said bleed passage increases the pressure in said control chamber to produce a pressure force tending to move said piston valve so as to block flow through said aperture in said partition member.

2. A refrigerant control valve for an air conditioning system including an evaporator and a compressor comprising: an elongated housing defining an interior space and having an inlet and an outlet at either end adapted to be connected respectively to the evaporator and the compressor for fluid flow through the elongated housing; a partition member extending across said interior space between said inlet and outlet and having an aparture therethrough encircled by a valve seat portion of said member; said partition member having an annular wall portion encircling said valve seat portion inward from the peripheral edge of said partition member and extending axially toward the inlet end of the housing; a piston valve reciprocally supported within said annular wall portion of said partition member in coaxial alignment with said inlet, outlet and aperture and having a reduced diameter end portion movable with respect to said valve seat portion of said partition member to control refrigerant flow through said aperture; enclosure-forming means including said partition member and said piston valve defining a pressure control chamber whereby a pressure force on said piston valve is produced to position the valve with respect to said valve seat; said enclosure-forming means having a restricted opening between said control chamber and an upstream portion of said interior space for admitting refrigerant to the control chamber and a bleed passage between said control chamber and a downstream portion of said interior space for discharging refrigerant from said control chamber; a bleed valve assembly having a body portion and an end portion which is coactive with said bleed passage for controlling refrigerant discharge from said control chamber to regulate the pressure in said control chamber; a temperature responsive sensoractuator including a housing having a rigid walled portion and a resiliently walled portion with said walled portions closely spaced to define an interior of relatively small volume filled with water whereby ice formation in said interior causes outward movement of said resilient wall with respect to said rigid wall; said sensor-actuator being supported at a peripheral edge of its rigid wall and with said resilient wall adjacent said bleed valve so that movement of said resilient wall caused by ice formation in said sensor interior produces a closing force on said bleed valve whereby the resultant restriction of fluid flow through said bleed passage increases the pressure in said control chamber to produce a pressure force tending to move said piston valve so as to block flow through said aperture in said partition member; said bleed valve assembly being spring biased away from said bleed passage portion of said piston valve and toward said sensor-actuator to provide continuous contact between said sensor-actuator and said bleed valve; the body portion and the end portion of said bleed valve assembly being movable in an axial direction with respect to one another to permit axial contraction thereof when said resilient wall of the sensor-actuator continues to move outward subsequent to engagement between said end portion and said piston valve.

* * * * *